US006789453B2

(12) United States Patent
Whiteman

(10) Patent No.: US 6,789,453 B2
(45) Date of Patent: Sep. 14, 2004

(54) FINE-TUNABLE PAPER STOP FOR PAPER PUNCHING MACHINE

(75) Inventor: Marvin Whiteman, Boise, ID (US)

(73) Assignee: Performance Design, Inc., Boise, ID (US)

( * ) Notice: Subject to any disclaimer, the term of this patent is extended or adjusted under 35 U.S.C. 154(b) by 0 days.

(21) Appl. No.: 10/150,656

(22) Filed: May 16, 2002

(65) Prior Publication Data

US 2002/0170403 A1 Nov. 21, 2002

Related U.S. Application Data

(60) Provisional application No. 60/291,735, filed on May 16, 2001.

(51) Int. Cl.[7] ..... B26F 1/14

(52) U.S. Cl. ..... 83/468.7; 83/522.19; 83/618

(58) Field of Search ..... 83/468.7, 468, 83/522.19, 618, 687, 446; 269/315, 181, 182; 412/9, 11, 16

(56) References Cited

U.S. PATENT DOCUMENTS

| | | | | | |
|---|---|---|---|---|---|
| 509,764 | A | * | 11/1893 | Preece | 83/468.7 |
| 894,398 | A | * | 7/1908 | Rouse | 83/468 |
| 3,060,780 | A | * | 10/1962 | Stuckens | 83/468 |
| 5,183,361 | A | * | 2/1993 | Ho | 412/16 |
| 5,211,522 | A | * | 5/1993 | Ho | 412/16 |
| 5,440,089 | A | * | 8/1995 | Prokop | 200/321 |
| 5,487,634 | A | * | 1/1996 | Vercillo | 412/16 |
| 5,575,188 | A | * | 11/1996 | Hu | 83/618 |
| 5,771,768 | A | | 6/1998 | Malmstrom | 83/571 |
| 6,047,623 | A | | 4/2000 | Whiteman et al. | 83/618 |

* cited by examiner

*Primary Examiner*—Stephen Choi
(74) *Attorney, Agent, or Firm*—Pedersen & Co., PLLC; Ken J. Pedersen; Barbara S. Pedersen

(57) ABSTRACT

Embodiments of features for a paper punch machine are shown and described. Preferably, these features, which may be called "accessories" whether they are built-in original equipment manufacture or retrofit equipment, assist in proper paper alignment and punch control. A first accessory is an improved paper stop that is both grossly-adjustable and finely-adjustable, by a preferred combination of a biased sliding mechanism, followed by a fine-tuning mechanism gradually laterally moving the paper stop by causing a threaded shaft to rotate after the paper stop is already in the preferred "gross-adjustment" position. This way, the paper stop is brought close to the proper marking on the housing appropriate for a particular paper or die assembly, and then exact adjustment may be made in very small and precise amounts. If desired, the user may record or remember how may turns of the threaded shaft are typically required for a particular fine-tuning job, because the threads on the threaded shaft represent quantifiable and reproducible adjustments.

14 Claims, 7 Drawing Sheets

FINE-TUNABLE PAPER STOP FOR PAPER PUNCHING MACHINE

This application claims priority of prior, co-pending provisional application Serial No. 60/291,735, entitled "Accessories for Paper Punching Machine," filed May 16, 2001, the disclosure of which is incorporated herein by this reference.

BACKGROUND OF THE INVENTION

1. Field of the Invention

This invention relates generally to automatic paper hole punches, for preparing paper for binding into spiral-bound, comb-bound, or other notebooks for conventions, operating manuals, sales presentations, etc. More specifically, this invention relates to features of such machines that assist in paper hand-placement and in punch actuation.

2. Related Art

Many automatic punch machines have been built for medium to small scale print and binding operations. Such punches are made by Performance Design, Inc., of Boise, Id., for example, versions into which a die assembly is bolted, or versions with quick-die-change punches such as are illustrated in U.S. Pat. Nos. 5,771,768, and 6,047,623, for example.

Prior art punch machines (P1, P2) include die assemblies for punching holes through a stack of papers prior to binding. Preferably, as shown in FIG. 1B, the die assembly (D) is slid and clamped into the machine and the die assembly has a long, vertical paper-receiving slot (S) for receiving the paper vertically, and accessible through housing opening (H). Paper is slid into the die assembly slot, so that about 1 inch of the edge of the paper resides in the slot. The die assembly includes a plurality of punch pins that are forced generally perpendicularly across the slot, through the paper near the paper edge. As the punch pins are driven across the slot to cut through the paper, each punch pin creates a hole in each paper at the location of each punch pin. Once a paper stack is properly inserted into the slot, the punch is actuated, typically by a foot pedal. Stacks of approximately 10–25 sheets are punched at a time, and then many stacks are combined for binding to make a notebook. Proper placement of each stack of paper in the die assembly slot is important, so that the final combined stack of paper to be bound into a notebook has all holes properly aligned and no holes are "off the edge."

Many conventional paper punch machines include a movable paper stop that determines the farthest position to one end of the die assembly to which the paper may slide. Prior art paper stops are shown in FIGS. 1A and 1B at PS. The paper stop is particularly useful because differently-sized papers are typically used in the machine at different times. Also, different die assemblies made for various binding coils and combs have uniquely sized, spaced and shaped sets of holes, which also requires adjustment of the paper stop when a die assembly is changed. For example, when the user wishes to punch standard 8-½-×-11-inch paper instead of the 14-inch paper, the user must move the paper stop 60 to accommodate the paper and also move the stop each time he/she changes the die assembly. For example, if the paper stop adjustments are not made when switching from 14 inch paper to 11 inch paper, the punched holes are not centered along the 11-inch paper edge. The holes may be slightly offset to the right or left, and a partial hole may be cut at one or both ends of the paper edge. Non-adjustment of the paper stop, therefore, may result in inferior binding and an unprofessional appearance due to non-aligned pages or partial holes at the ends of some papers.

Many adjustable paper stops are difficult to use properly. This is especially because the paper stop, when loosened for movement, tends to move easily or be bumped easily from its original position, and the user loses the reference point from which the stop should be adjusted. The conventional paper stop is usually a fairly clumsy device that requires the user to do many repetitions of punching a few sheets of paper, resetting the stop, punching more sheets to check paper and hole position, resetting the stop, etc.

An additional feature of some conventional punch machines is a foot-operated actuating system for turning the punching function on and off. A foot pedal is typically used to actuate a punching action, after the user inserts the paper stack into the die assembly slot. Actuation comprises the machine's drive mechanism moving a back portion of the die assembly forward toward the die assembly front portion to force the pins through the paper stack in the slot. After punching through the paper, the back portion withdraws the pins from the paper while returning to its rearward position in the machine. After the user reloads the die assembly with paper, he/she again presses the feet-pedal and the machine punches the fresh stack. This procedure, therefore, requires coordinated action by the user, both from his hands and his foot or feet, which can require postures or stances that are uncomfortable or frustrating for the user.

Therefore, there is a need for improved accessories for a paper punch. Particularly, there is a need for an improved paper positioning system or "paper stop" that is more accurate and easy to use without repetitious trial and error. Also, there is a need for an improved actuation system that is more ergonomic and convenient. The present invention addresses these and other needs.

SUMMARY OF THE INVENTION

The invention comprises one or more accessories for making paper punching operation more comfortable and accurate for the user, thus saving time and paper, and making the job more convenient and safe for the user. A first accessory is a fine-tunable paper stop, which comprises a main adjustment system plus a fine-adjustment system, to produce an accurate, reproducible, and quick paper stop operation. A second accessory is an adjustable actuation switch in a location when the user may actuate the punching operation with generally the same motion that he/she uses to insert paper into the die assembly.

While one or the other of the accessories may be installed and used independently, together they provide a greatly-improved system for paper management and punch operation. The user may quickly adjust the paper stop to the general area that is desired for a particular type of paper and/or die assembly, and then may easily fine-tune the setting without repeated retries and errors. The user may actuate the punch machine with the same hand and generally the same motion used for insertion of the paper—as the user slides the paper into the slot, he/she may press his hand or wrist on the actuation switch that is generally adjacent to the die assembly paper slot, rather than using a foot pedal.

The preferred paper stop includes a securable connection of the paper stop to the machine housing near the slot, which securable connection allows the paper stop to be released and slid along the longitudinal direction parallel to the die assembly slot, and then secured again after the paper stop is in the grossly-adjusted position. Preferably, the securable connection is a biased connection, wherein the paper stop may be pulled into a slidable "released" position, so that the paper stop may be slid along the length of the slot. When the paper stop is positioned during this "main" or "gross adjustment" generally in the desired area, the paper slot is released so that it is biased back to its "engaged" position.

Then, after typically only one or two tries at punching the paper and checking to see how the holes line up on the paper edge, the paper stop is fine-tuned to the desired position for proper and accurate punching. Preferably, the paper stop securement system (or "securable connection") is still operative during fine-tuning of the paper stop location, so that the paper stop is not ever loose, wobbly or otherwise easily moved into an undesirable position either between gross adjustment and fine-adjustment, or after fine-adjustment.

The fine-adjustment (or "fine-tuning") is preferably done by a threaded adjustment that moves the paper stop longitudinally slowly and in a continuous manner, rather than in increments. The preferred paper stop is disposed perpendicular to an elongated, threaded member that extends parallel to the slot. The elongated threaded member rotates on its axis, controlled by an external knob accessible to the user. The paper stop, when in the engaged position, has a threaded end that engages and cooperates with the threads of the elongated threaded, so that rotating the threaded member serves to move the paper stop longitudinally along the direction of the threaded member axis, thus, fine-adjusting the paper stop relative to the length of the slot and the die assembly punch pins.

The improved paper stop allows both grossly-adjustable and finely-adjustable, by the preferred combination of a biased sliding mechanism, followed by a fine-tuning mechanism gradually laterally moving the paper stop by causing a threaded shaft to rotate after the paper stop is already in the preferred "gross-adjustment" position. This way, the paper stop is brought close to the proper marking on the housing appropriate for a particular paper or die assembly, and then exact adjustment may be made in very small and precise amounts. If desired, the user may record or remember how may turns of the threaded shaft are typically required for a particular fine-tuning job, because the threads on the threaded shaft represent quantifiable and reproducible adjustments.

The two preferred features for a paper punch machine may be called "accessories" whether they are built-in original equipment manufacture or retrofit equipment. Both assist in proper paper alignment and punch control.

DETAILED DESCRIPTION OF THE INVENTION

Referring to the Figures, there are shown some, but not the only, embodiments of accessories that make paper placement and punching more convenient, accurate, and comfortable for the user of an automatic or semiautomatic punch machine.

Figure 1A:
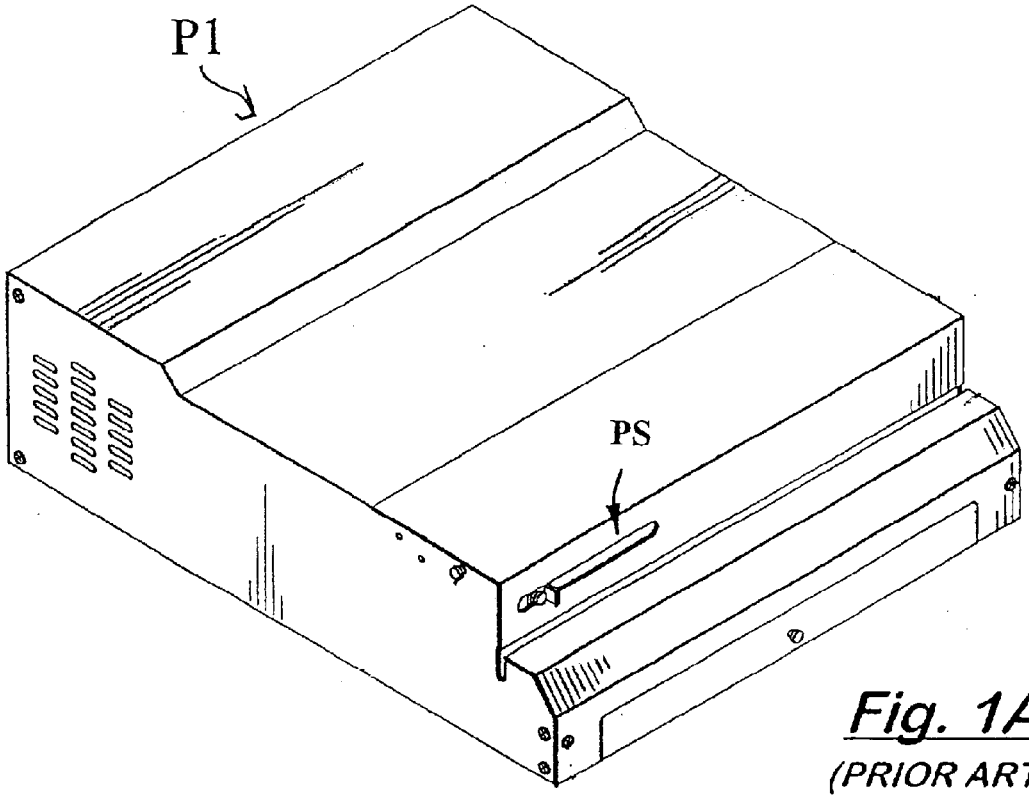
Fig. 1A (PRIOR ART)
FIG. 1A is front perspective view of a prior art paper punch machine that includes a prior art paper stop.
Figure 1B:
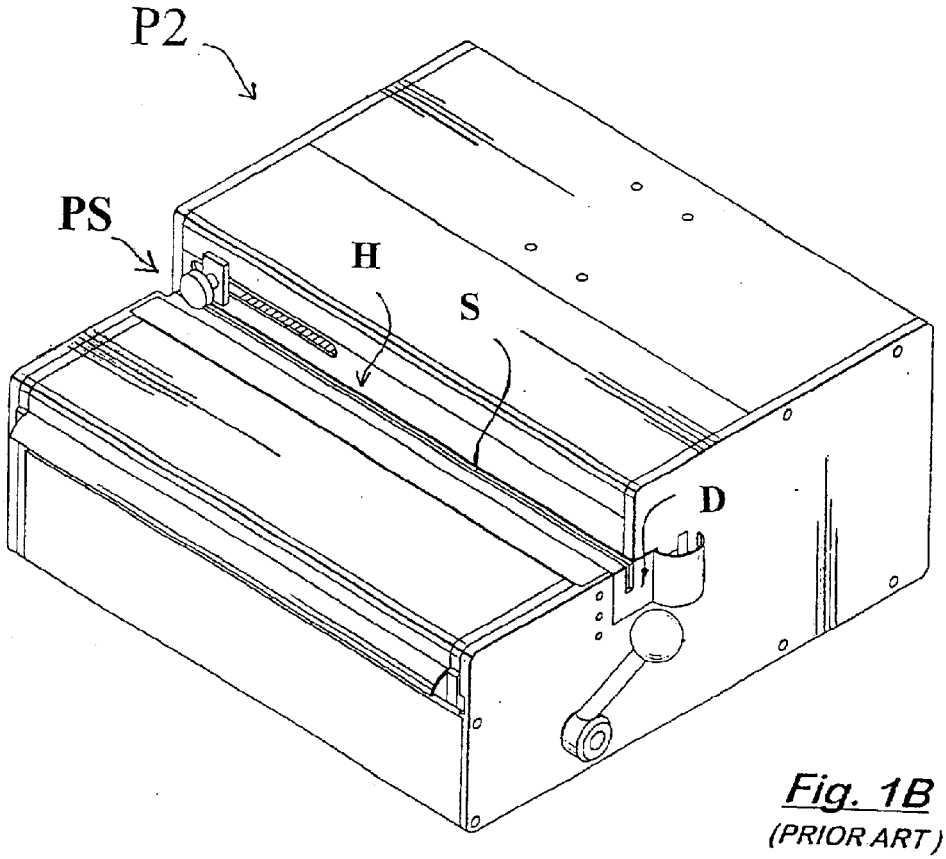
Fig. 1B (PRIOR ART)
FIG. 1B is a front perspective view of another prior art paper punch machine that includes a prior art paper stop.
Figure 2:
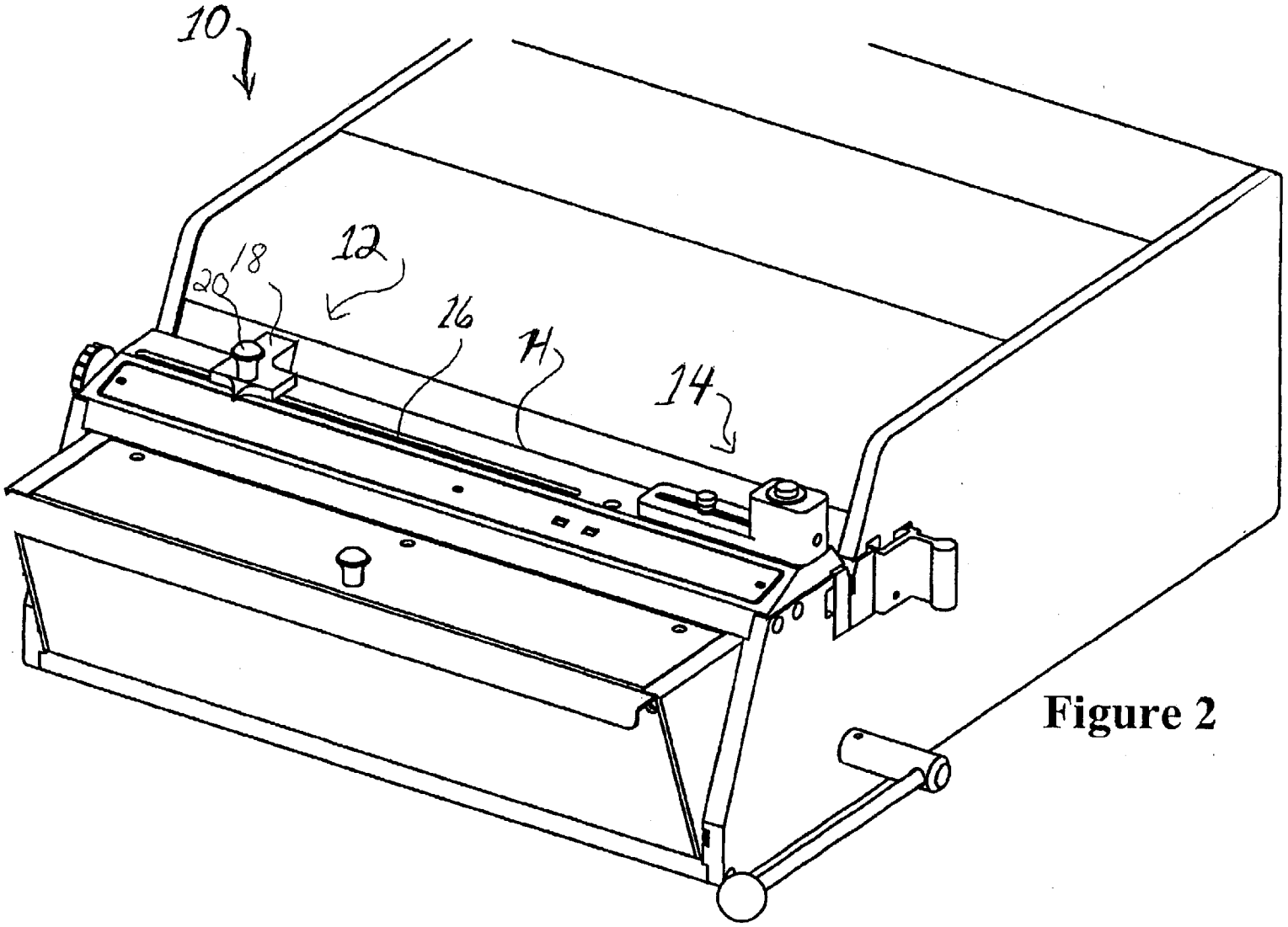
FIG. 2 is a front perspective view of one embodiment of a paper punch machine with a paper stop system and an actuation switch system according to embodiments of the invention.
Figure 3:
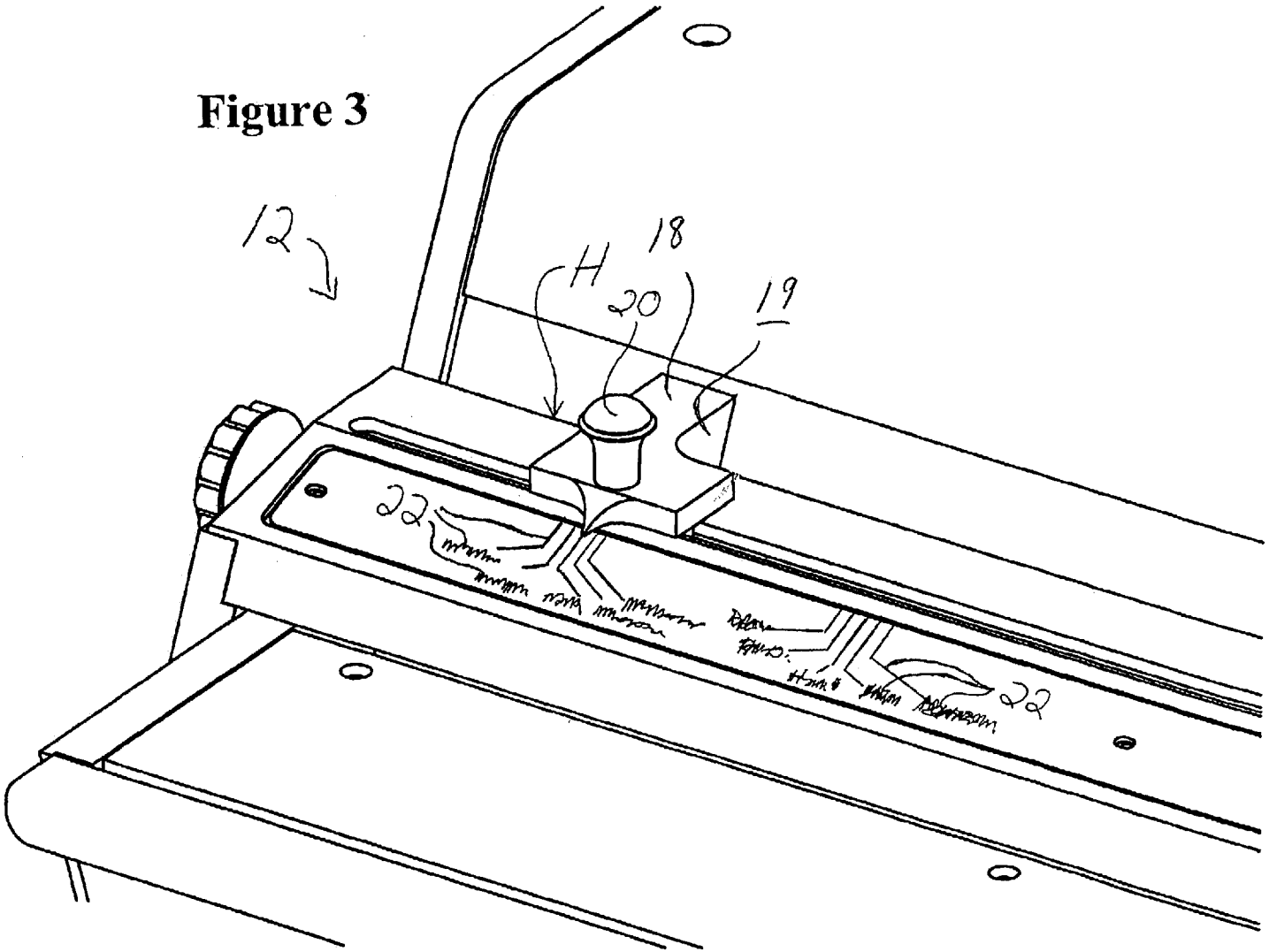
FIG. 3 is a partial, enlarged front perspective view of the left end of the embodiment of FIG. 2.
Figure 4:
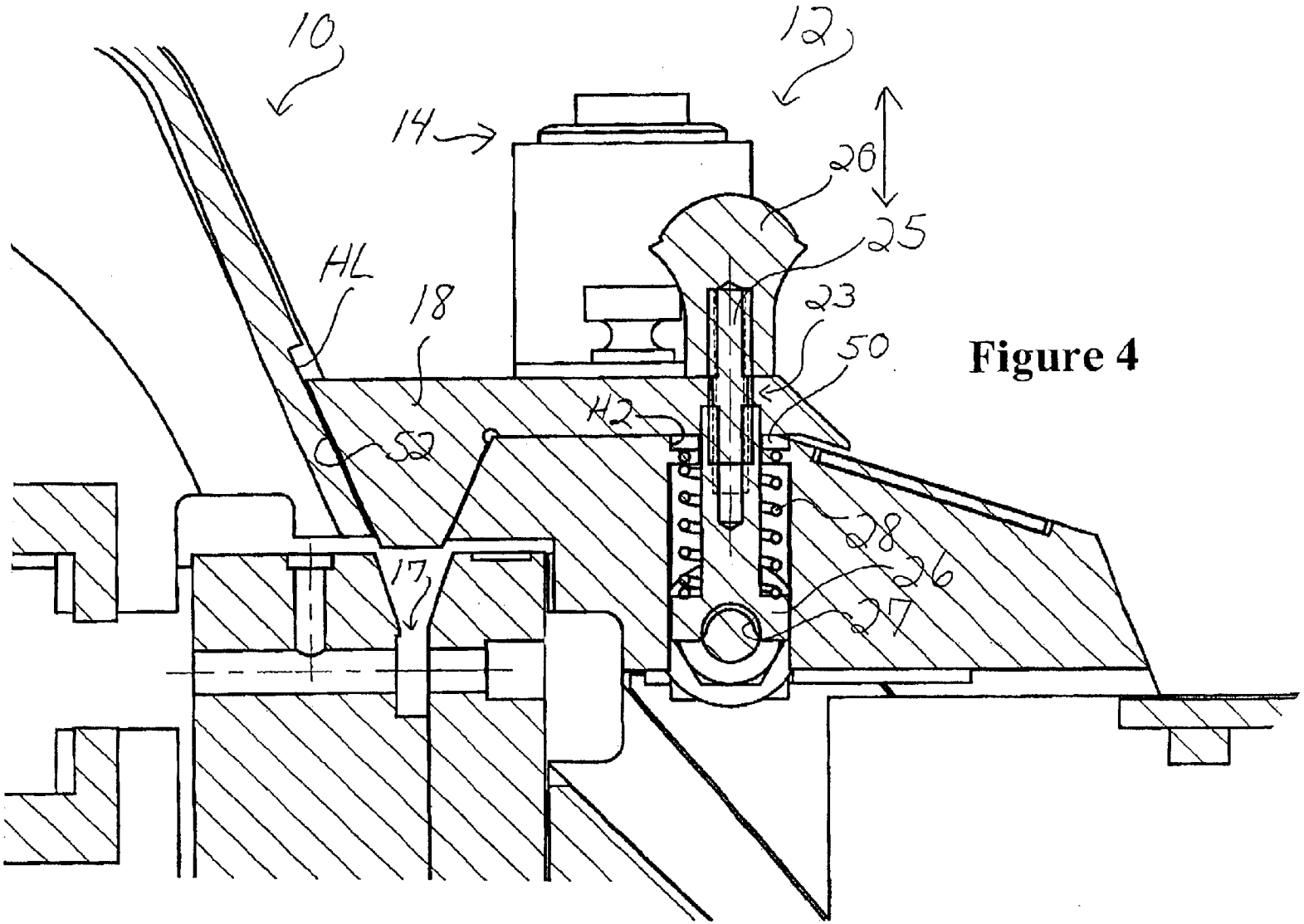
FIG. 4 is a left end, cross-sectional view of the preferred paper stop system of FIGS. 2–3.

The Figures illustrate placement, operation, and structure of embodiments of the invented paper stop 12 and the actuation switch 14 in a preferred paper punch machine 10. The paper stop 12 is shown on the machine 10 to best advantage in FIGS. 2 and 3. The actuation switch 14 is shown to best advantage in FIGS. 2 and 4.

The paper stop 12 moves along its own slot 16, parallel to the length of the slot 17 in the die assembly, which die assembly slot is directly below opening H in the housing. A stop portion 18 extends across the housing opening H, so that one end edge of the paper stack contacts/abuts the generally vertical stop surface 19 as the paper rests in the slot of the die assembly. The stop portion 18 serves, therefore, as a limit for longitudinal movement of the paper relative to the die assembly and therefore determines how the paper is aligned relative to the punch pins. The paper stop also includes knob 20 for user access to the main "macro" adjustment mechanism offered by the paper stop. By making "macro" adjustment, that is, large adjustments in the position of the paper stop relative to the housings with its markings 22, the paper stop is also being moved along the length of the slot that receives the paper. Once the paper stop is moved along to approximately its desired position, as indicated by the markings 22 that correspond to the type of paper to be punched and the type and arrangement of punch holes/die assembly to be used, then fine adjustment may be used. The structure and workings of the paper stop are described below:

To make large, "macro," or "gross" adjustments, user pulls up on the knob 20, which lifts the knob and its attached engagement mechanism 23 up away from elongated member 24 (against a bias provided by the spring or other bias system) and out of a position in which the paper stop is retained/prevented from making any longitudinal movement. Engagement mechanism comprises a shaft 25, threaded inner end member 26 ("threaded nut") having internal threads on curved inner surface 27, and biasing member (preferably a spring 28). When the engagement mechanism 23 is pulled up, threaded nut 26 moves away from the threads of member 24, perpendicularly to member 24, so that the nut 26 threads do not engage and are not held from movement in a longitudinal direction (that is, along the axis of the member 24, which is parallel to the longitudinal axis of the slot and die assembly.) Stop portion 18 is preferably rigidly connected to the shaft 25 by means that prevent stop portion 18 from rotating around the axis of the shaft 25 and from moving up or down the shaft 25. Thus, when knob 20 and engagement mechanism 23 are pulled up, stop portion 18 moves upward also as part of the combined unit (of knob 20, shaft 25, and threaded nut 26, and stop portion 18), and the combined unit may then be slid longitudinally to the desired vicinity as suggested by the preprinted markings 22. Because bias is maintained that tends to pull the combined unit downward, and because the stop portion 18 is prevented from rotating relative to the shaft 25 and the combined unit is prevented from rotating on the axis of the shaft 25, the movement of the paper stop tends to be controlled, predictable, and accurate, as opposed to the "looser" control and movement of conventional paper stops. Preventing the stop portion 18 from rotating relative to the shaft, and preventing the shaft and its nut 26 from rotating relative to the elongated threaded member 24 and the housing may be done by various methods, including square protrusions/nuts 50 that extend radially out from the otherwise round shaft to fit in square holes to prevent rotation. For example, which a square nut may be vertically slidable relative to the housing H2 in a square hole in the housing H2 but that will not rotate in the square housing hole. Or, a square nut on the shaft and square hole in the stop portion (not shown) may be used to prevent rotation of the stop portion relative to the shaft. Also, the housing lid HL preferably abuts against a surface 52 of the stop portion 18 to retain the stop portion 18 from rotation.

Once the gross adjustment has been made, the knob 20 is released and the biasing member urges the combined unit down again so that the threaded nut 26 contacts the elongated member 24 and threadingly engages the member 24. The female threads of the nut 26 match the male threads of the member 24 so that the nut 26 and member 24 cooperate, as a bolt and matching nut would do. Nut 26 preferably extends circumferentially half way (or less) around the member 24, that is, one could consider it preferably half of a nut of a bolt and nut combination.

Figure 5:
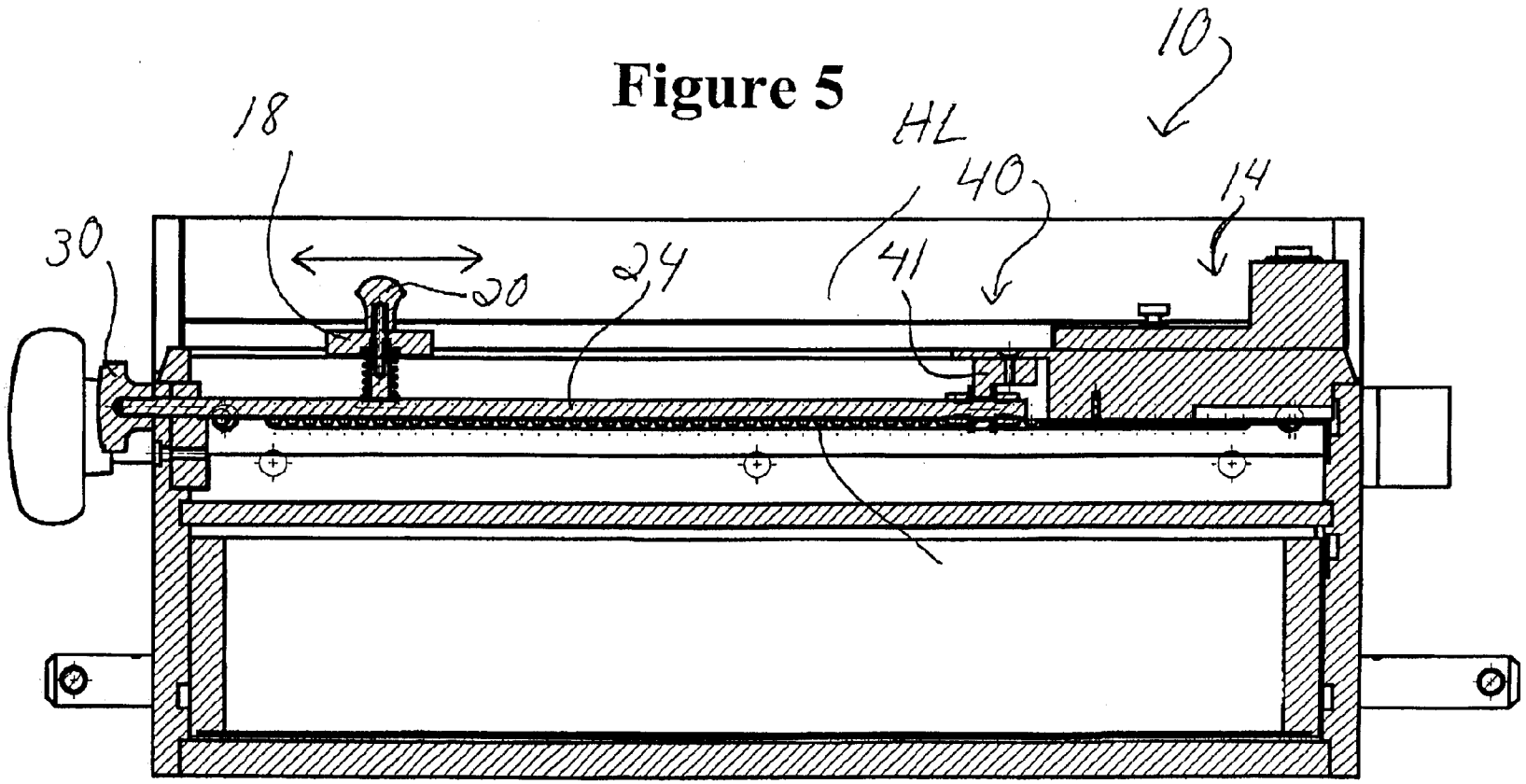
FIG. 5 is a front, cross-sectional view of the machine of FIGS. 2–4, illustrating the paper stop system in front of the die assembly with its hole punch pins and holes, and the actuation system on the right end of the machine.
Figure 6:
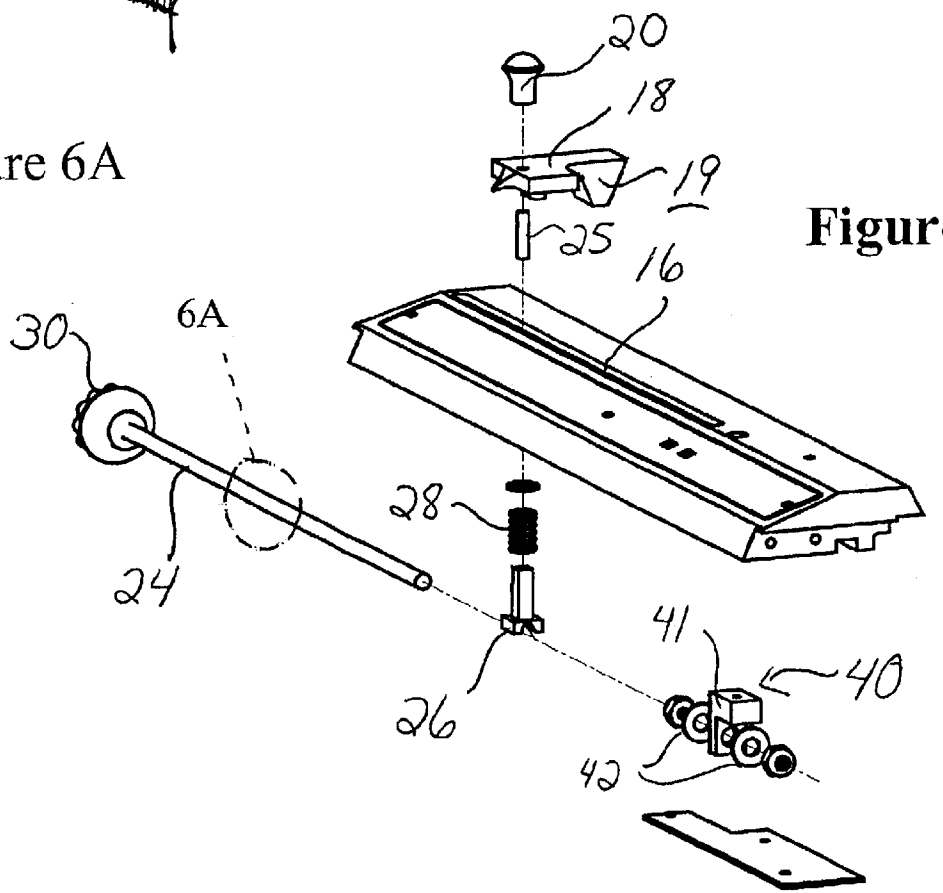
FIG. 6 is an exploded view of the pieces parts of the preferred paper stop system of FIGS. 2–5.
Figure 6A:
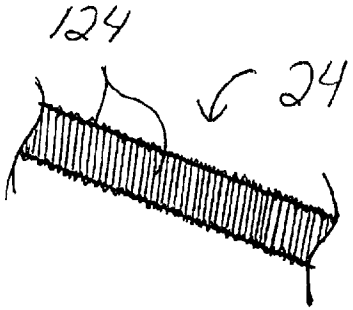
FIG. 6A is a partial detail view of a portion of the threaded member of the paper stop system in FIG. 6.

As illustrated in FIGS. 5, 6, and 6A, elongated member 24 is long and threaded along all or substantially all its length. Preferably, elongated member 24 and paper stop slot 16 extend about ¾ of the way, and preferably at least half of the way, along the distance between the sides of the machine 10. This way, the paper stop 12 may be adjusted for many various papers and die assemblies. A fine-tuning knob 30 is connected at the outer end of the member 24. The member 24 is mounted inside the housing, preferably at its inner end, by a mounting system that allows the threaded member 24 to rotate on its axis but not move longitudinally support system that allows rotation of the member inside the retaining/bearing rings of bearing system 40 while maintaining the member parallel to the die assembly, while the member 24 rotates. Retaining member 41 of the bearing system 40 is anchored in the housing, as one of various means for supporting the member 24, and bearings 42 are positioned preferably on both sides of the retaining member 41. Thus, one may see that the member 24 does not move in an axial direction or away from a single axis of rotation, but the threads move in a radial direction, causing axial movement of the threaded nut 26. Thus, when the user rotates the knob 30 to rotate the member 24, the member 24 does not "screw" into or out of the housing, but movement of the threads of the member 24 do exert a force on the threaded nut 26 by virtue of the nut 26 threads and the member threads 124 being mated. This movement causes the nut 26 to move longitudinally from its gross adjustment location, either in toward the center of the die assembly (when the knob 30 is rotated a first direction) or out toward the outer left side of the machine (when the knob 30 is rotated in an opposite direction). The threads 124, which are only shown in FIG. 6A, are positioned so that the member 24 has a small screw lead angle. This way, the user may finely control the position of the nut 26 (and consequently the paper stop surface 19).

Preferably, the screw lead angle of the member 24 is designed so that about ¼–1 turn of the knob 30 is needed to fine-tune the paper stop position after the gross adjustment is done. Therefore, the user may learn to conduct the gross "macro" positioning of the paper stop, and, after one trail punch of paper and viewing of the hole position, will quickly learn the amount of fine-tuning that is needed. For example, depending on the screw lead angle, the user may quickly learn, for example, that moving the paper about ⅛ hole width relative to the die assembly requires fine-tuning the paper stop by moving the knob 30 about ¼ rotation. Or, the user will quickly learn, for example, that moving the paper about ¼ hole width requires fine-tuning the paper stop by turning the knob 30 about ½ rotation. These are examples, and other sensitivities may be designed into the paper stop system.

One may see from these examples that it takes many turns of the knob 30 (and member 24) to move the stop portion 18 a significant distance along the machine over the slot 17. For example, one could expect to turn the knob 30 many rotations to move the stop portion 18 an axial distance of one inch. Such an adjustment of one inch by the knob 30 and threaded member 24, however, would typically be unnecessary and undesirable because the "lift and slide" gross adjustment may be used to move the stop portion on the order of about ¼ inch to several inches. This gross adjustment places the stop portion 18 very close to the location desired for perfect hole punching (preferably within about 1/32–⅛ inch, or at least within about ¼ inch of the precise location desired). Because of the practicalities of changing between many different die assemblies and many different papers, and the natural inconsistencies of manufacture and operation, the gross adjustment will often not place the paper exactly where it needs to be for perfect hole placement, and, hence, the fine-tuning adjustment provided by the threaded member system is an excellent feature for these semi-automatic punch machines.

The invented system, therefore, allows for gross adjustments by freeing the paper stop preferably entirely from the member 24 that retains it in a longitudinal location. Then, once the paper stop "springs" into its grossly-adjusted position engaging the threaded member, the threaded member 24 may itself be turned to produce very small amounts of longitudinal movement relative to the housing, die assembly, and therefore the punch pins. Some trial and error may still be needed to find the exact preferred location for the paper stop, but, because the paper stop is not loose and easily bumped out of position at any time during its adjustment, the process is much easier and more accurate and reliable than conventional paper stop use.

Figure 7:
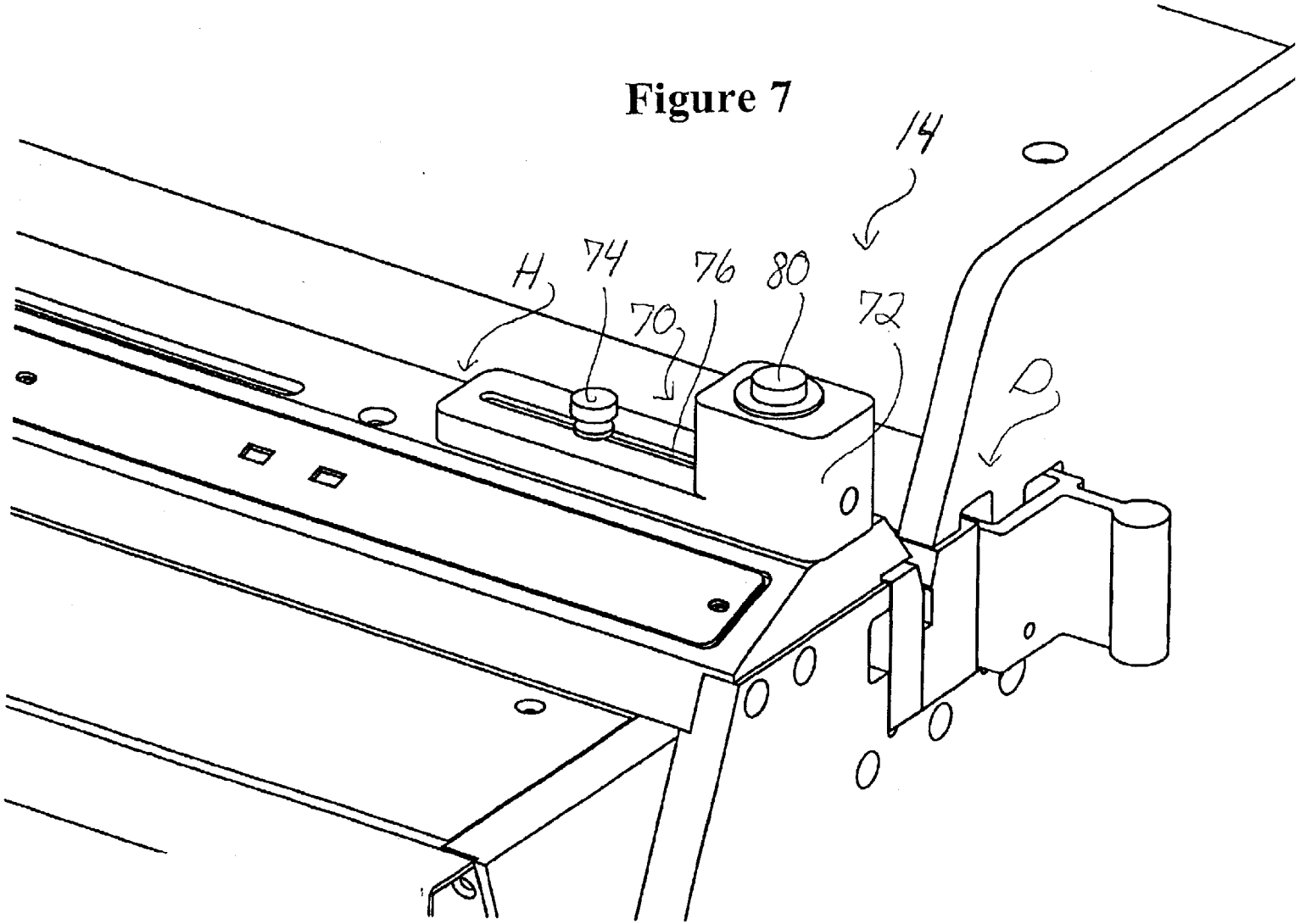
FIG. 7 is a perspective view of the top right end of the punching machine, illustrating the preferred embodiment of the actuation system according to the invention.

FIG. 7 illustrates the preferred actuating accessory 14 for paper punching machine 10 that makes easier the actuation of the punching operation. This accessory 14 comprises an adjustable actuation switch assembly 70 shown on the top of the punch machine, preferably on a top, forward surface near the right end of the housing opening H and the right end of the die assembly D. This switch assembly 70 includes a base 72 that is slidably mounted on the housing surface, preferably by an adjustable system including a fastener 74 tightenable in a longitudinal slot 76 in the base 72. The fastener 74 connects to the housing and tightens down to secure the base of the switch assembly against movement, either longitudinal or rotational movement relative to the housing. This may, when fastener 74 is purposely loosened, the base may be slid longitudinally to the desired position, and the fastener 74 tightened, so that the switch assembly 70 is in a proper location for use with a particular punching job—that is, for a particular paper size, and paper location in the die. Preferably, the "proper location" means that the user adjusts the switch assembly 70 location so that when he/she inserts a stack of paper into the slot of the die assembly, the user's hand will be aligned to easily come in contact with the switch button 80 at an appropriate time. "The appropriate time" means, preferably, after the paper is in place, so that the punch drive is switched on for punching while the user is holding the paper in position, or just after the user has placed the paper in position and the user's hand is still close to the paper on the right side of the machine (mirror image machines and switch assemblies may certainly be designed). Thus, for short paper, the switch assembly is moved farther to the left, so that the switch button 80 is closely convenient to the user's right hand as soon as the paper is in place, with no or little movement of the hand except for the hand to come down on the button 80. Appropriate electrical/electronic connection and control mechanisms (not shown, preferably internal) may be supplied to connect the switch cooperating with the button 80 to the drive and/or other controls for the machine. The switch assembly 70 may be a disconnectable accessory, or may be made generally integral with the machine 10.

Thus, the invention may be said to comprise a paper punch machine that has a housing and a die assembly with a longitudinal slot for receiving paper to be punched by the die assembly, and a paper stop system. The preferred paper stop may be said to comprise an upper stop portion extending transversely across the paper-receiving slot of the die assembly so that edges of the paper abuts against said upper stop portion when the paper is in said paper-receiving slot. The preferred paper stop is movable into a sliding position wherein the paper stop is longitudinally along the housing parallel to the paper-receiving slot, and also movable into a non-sliding position wherein the paper stop does not slide longitudinally along the housing parallel to the paper-receiving slot. Whether the paper stop is in the released, sliding position (pulled outward from the housing) or in the temporarily-anchored non-sliding position is controlled by the inward force of the biasing system vs. the outward force of the user, who purposely and manually pulls the paper stop outward and slides the paper stop along the housing to obtain the gross adjustment. Thus the preferred biasing system as shown, and others that might be designed after seeing this disclosure, are adapted anchor the paper stop unless the user is pulling/holding it out. The fine-tuning system is operatively connected to said paper stop for moving said paper stop longitudinally to a finely-adjusted position when the paper stop is in said non-sliding position, wherein the preferred fine-tuning system comprises a rotatable member with a threaded portion engaging a lower end of the paper stop so that rotating the threaded member moves the paper stop longitudinally parallel to the paper-receiving slot due to the threaded interaction of the member and the lower end. Thus, when the biasing member is biasing the paper stop into threaded engagement with the threaded member (or threaded rod), preferably only fine-tuning is possible and there is no movement of the paper stop unless the threaded member (rod) is rotated by the user. When the user has pulled the paper stop out of engagement with the threaded rod, then the paper stop system is back in gross-adjustment mode and the paper stop can be slid along the slot/housing, but fine-adjustment by the threaded rod system is not possible.

Although this invention has been described above with reference to particular means, materials and embodiments, it is to be understood that the invention is not limited to these disclosed particulars, but extends instead to all equivalents within the scope of the following claims.

What is claimed is:

1. In a paper punch machine comprising a housing and a die assembly with a longitudinal slot for receiving paper to be punched by the die assembly, an improvement comprising a paper stop system, the paper stop system comprising:

a paper stop having a stop portion extending over the paper-receiving slot of a die assembly and having a stop surface against which paper abuts when placed in said paper-receiving slot;

a connection system movably connecting the paper stop to the machine so that the paper stop is movable on the housing parallel to the paper-receiving slot to a grossly-adjusted position;

a securement system adapted to temporarily hold the paper stop in fixed relationship relative to the paper-receiving slot;

a fine-tuning system operatively connected to said paper stop for moving said paper stop longitudinally from said grossly-adjusted position to a finely-adjusted position, wherein said fine-tuning system comprises a threaded member extending longitudinally and operatively engaging the paper stop so that turning the threaded member moves the paper stop longitudinally parallel to the paper-receiving slot, and the improvement further comprising an actuation system on an upper front surface of said housing near the paper-receiving slot and at an opposite end of paper-receiving slot from the paper stop, the actuation system comprising a slidable member that is separate from the paper stop that is movable longitudinally along said upper front surface, and an actuation button on an upper surface of the slidable member operatively connected to a switch for actuating punching by the machine, wherein the actuation button is adapted to be pushed down in a direction perpendicular to the longitudinal slot by a user's hand, and wherein the actuation system is adapted to be adjustable for use with different papers and for different users by the actuation system being slidable in a direction parallel to the longitudinal slot and lockable at various distances from said paper stop.

2. The paper stop system of claim 1, wherein the securement system is also adapted to hold the paper stop in fixed relationship relative to the paper-receiving slot after the paper stop has been fine-tuned by turning of the threaded member.

3. The paper stop system of claim 2, wherein the threaded member extends longitudinally across at least half of the paper punching machine.

4. The paper stop system of claim 1, wherein the securement system is a biasing system that biases the paper stop against the housing.

5. The paper stop system of claim 4, wherein the biasing system is adapted so that the paper stop is released into a slidable position by pulling on the paper stop in a direction against the bias of the biasing system.

6. The paper stop system of claim 1, wherein said paper stop is generally perpendicular to the threaded member and has a threaded inner end operatively engagable with the threaded member, wherein moving threads of said rotating threaded member force the threaded inner end to move longitudinally.

7. In a paper punch machine comprising a housing and a die assembly with a longitudinal slot for receiving paper to be punched by the die assembly, an improvement comprising a paper stop system comprising:

a paper stop having an outer stop portion extending transversely across the paper-receiving slot of a die assembly so that edges of the paper abuts against said outer stop portion when the paper is in said paper-receiving slot, and wherein the paper stop is slidably connected to the punching machine for sliding along the housing parallel to the paper-receiving slot;

a biasing system adapted to bias the paper stop into, and releasably hold the paper stop in, a non-sliding position wherein the paper stop is not longitudinally slidable parallel to the paper-receiving slot, and wherein said biasing system holds said paper stop in said non-sliding position unless the paper stop is manually pulled out away from the housing into an outward, sliding position;

a fine-tuning system operatively connected to said paper stop for moving said paper stop longitudinally to a finely-adjusted position when the paper stop is in said non-sliding position, wherein said fine-tuning system comprises a threaded member extending longitudinally and operatively engaging the paper stop so that rotating the threaded member moves the paper stop longitudinally parallel to the paper-receiving slot, the improvement further comprising an actuation system on an upper front surface of said housing of the paper punching machine near an end of the paper-receiving slot opposite the paper stop, the actuation system comprising a slidable member that is movable longitudinally along said upper front surface parallel to the paper-receiving slot, and an actuation button on a surface of the slidable member operative connected to a switch for hand-actuating of the punching action of the machine by a user's hand after hand-insertion of the paper by the user.

8. The paper stop system of claim 7, wherein said biasing system holds the paper stop in said non-sliding position by biasing a threaded inner end of the paper stop into engagement with the threaded member.

9. The paper stop system of claim 7, wherein said fine-tuning system being operatively connected to said paper stop comprises the threaded inner end of the paper stop being biased into engagement with the threaded member so that rotating the threaded member move the threaded inner end.

10. The paper stop system of claim 7, wherein the paper stop extends perpendicularly relative to the threaded member, and the paper stop has a knob on its outer stop portion for access by a user to pull against the bias of the biasing system to release the paper stop into the slidable position.

11. The paper stop system of claim 10, wherein releasing the paper stop into the slidable position comprises moving the threaded inner end out of engagement with the threaded member.

12. A paper punch machine comprising a housing and a die assembly with a longitudinal slot for receiving paper to be punched by the die assembly, and a paper stop system, wherein the paper stop system comprises an upper stop portion extending transversely across the paper-receiving slot of the die assembly so that edges of the paper abuts against said upper stop portion when the paper is in said paper-receiving slot, and wherein the paper stop is movable into a sliding position wherein the paper stop is longitudinally along the housing parallel to the paper-receiving slot, and movable into a non-sliding position wherein the paper stop does not slide longitudinally along the housing parallel to the paper-receiving slot;

a biasing system adapted to bias the paper stop into the non-sliding position and to allow the paper stop to be manually-pulled by a user into the slidable position; and a fine-tuning system operatively connected to said paper stop for moving said paper stop longitudinally to a finely-adjusted position when the paper stop is in said non-sliding position, wherein said fine-tuning system comprises a rotatable longitudinal threaded member engaging a lower end of the paper stop so that rotating the threaded member moves the paper stop longitudinally parallel to the paper-receiving slot, further comprising an actuation system on an upper surface of said housing near an end of said paper-receiving slot opposite the paper stop, the actuation system comprising a switch with a switch button separate from the paper stop for actuating punching operation by the machine, the switch button facing upwards for being pressed by a user's hand that is placing paper in the paper-receiving slot.

13. The paper punch machine of claim 12, wherein said biasing system holds the paper stop in said non-sliding position by biasing the threaded inner end of the paper stop into threaded engagement with the threaded member.

14. The paper punch machine of claim 12, wherein the paper stop is pulled into said sliding position by pulling the paper stop outward from the threaded member to disengage the threaded inner end of the paper stop from the threaded member.

* * * * *